US007021950B2

(12) United States Patent
Borrego Bel et al.

(10) Patent No.: US 7,021,950 B2
(45) Date of Patent: Apr. 4, 2006

(54) SYSTEM AND METHOD FOR PREVENTING ELECTRIC ARCS IN CONNECTORS FEEDING POWER LOADS AND CONNECTOR USED

(75) Inventors: Carles Borrego Bel, Valls (ES); Joan Fontanilles Piñas, Valls (ES); Josep Maria Roset Rubio, Valls (ES); Gabriel Figuerola Barrufet, Valls (ES); Santiago Ferre Giró, Valls (ES)

(73) Assignee: Lear Corporation, Southfield, MI (US)

( * ) Notice: Subject to any disclaimer, the term of this patent is extended or adjusted under 35 U.S.C. 154(b) by 133 days.

(21) Appl. No.: 10/709,050

(22) Filed: Apr. 8, 2004

(65) Prior Publication Data

US 2004/0192092 A1 Sep. 30, 2004

(51) Int. Cl.
*H01R 13/53* (2006.01)

(52) U.S. Cl. ..... 439/181

(58) Field of Classification Search ..... 439/181
See application file for complete search history.

(56) References Cited

U.S. PATENT DOCUMENTS

| | | | | |
|---|---|---|---|---|
| 3,711,819 | A * | 1/1973 | Matthews | 439/682 |
| 3,945,699 | A | 3/1976 | Westrom | 439/38 |
| 4,034,172 | A | 7/1977 | Glover et al. | 200/51.1 |
| 4,749,357 | A | 6/1988 | Foley | 439/80 |
| 4,927,382 | A * | 5/1990 | Huber | 439/490 |
| 5,176,528 | A | 1/1993 | Fry et al. | 439/181 |
| 5,336,934 | A | 8/1994 | Toepfer et al. | 307/10.1 |
| 5,542,425 | A | 8/1996 | Marshall et al. | 600/437 |
| 5,676,571 | A | 10/1997 | Matthews | 439/843 |
| 5,952,741 | A | 9/1999 | Toy | 307/326 |
| 6,146,160 | A | 11/2000 | Chang | 439/137 |
| 6,225,153 | B1 | 5/2001 | Neblett et al. | 438/188 |
| 6,524,117 | B1 * | 2/2003 | Murakami et al. | 439/74 |
| 6,746,250 | B1 * | 6/2004 | Blutbacher | 439/34 |

* cited by examiner

*Primary Examiner*—Phuong T. Vu
*Assistant Examiner*—Scott Bauer
(74) *Attorney, Agent, or Firm*—Bruce E Harang

(57) ABSTRACT

A system and method for preventing electric arcs in connectors feeding power loads and connector used, Comprising several connectors (11) interspersed in an electric power distribution network, integrating first and second releasable socket coupling supports (1, 2) bearing at least one pair of terminals (3, 4) which, in a first coupling position A, are electrically coupled, forming a channel (5, 6) to a load (10), which terminals (3, 4), in another decoupling position C of the supports (1, 2), are separated, it being possible to generate an electric arc, each connector (11) comprising a pair of electroconductive elements (12, 13) which, in said position A or in intermediate decoupling position B, and before the terminals (3, 4) reach said position C, form an auxiliary electric circuit (14, 15) through which an electric warning signal is generated during a transition towards decoupling, there being a device (7) connected to the auxiliary circuit (14, 15) which, upon receiving said warning signal, interrupts the electric feed to said channel (5, 6) of the terminals (3, 4) prior to their physical separation.

2 Claims, 5 Drawing Sheets

SYSTEM AND METHOD FOR PREVENTING ELECTRIC ARCS IN CONNECTORS FEEDING POWER LOADS AND CONNECTOR USED

BACKGROUND OF INVENTION

1. Field of the Invention

The present invention refers to a system for preventing the formation of electric arcs in connectors interspersed in an electric power distribution network, particularly applicable to a network assembled in an automotive vehicle for feeding power loads, such as a 42V network of a vehicle with two voltage levels (14V and 42V, or dual voltage system) for the purpose of preventing that, when the connector components are fortuitously or accidentally separated, or due to a lack of warning of a handler, an electric arc between contact points is generated which causes destruction or early deterioration of said contacts, or of the connector itself, an ill-timed interruption of the feed to certain loads of the network, or a fire situation with more or less severe damage, especially during the disconnection of the two electroinsulating parts or supports, components of a connector, bearing the electroconductive contact terminals.

The invention is also especially interesting for electric vehicles in which a set of batteries is used to provide power to an electric motor intended for driving the vehicle, and in which the current levels are in the range of 400 A at 400 V for DC, and 40 A at 220 V for AC, which current and voltage values require the incorporation of a series of safety measures for minimizing the risk of injuries to users, mechanics and safety technicians.

The invention also refers to a method for preventing the formation of electric arcs, as well as to a connector used in said system and method.

2. Description of the Invention

There are numerous documents which tackle the drawback of electric arc formation, both upon connecting as well as, especially, upon disconnecting the two component parts of a connector incorporated in a load feed network, at a voltage level susceptible to generating said electric arcs.

Patents EP-A-697751, EP-A-673085 and U.S. Pat. No. 6,146,160 disclose connectors with means for an effective mechanical clamping of the connection terminals, typically pins and electroconductive sockets, such that an accidental disconnection thereof cannot occur.

U.S. Pat. Nos. 3,945,699, 4,749,357 and 5,676,571 disclose means associated to the electroconductive pin receiver females, provided for obstructing or minimizing electric arc formation when connecting the two connector components.

U.S. Pat. No. B1-6,225,153 discloses a universal charge port connector for electric vehicles, in which a mechanism is provided for cutting off the current susceptible to generating an arc during disconnection of the male and female terminals of the connector before decoupling of the two component parts of said connector, particularly for preventing the disconnection of the connectors while charging vehicle batteries, which mechanism includes a mechanical lock of said two parts actuated by a lever which is associated to a switch coupled to a power source for the connector assembly, through which switch, and when the lever is actuated by a user, current circulation towards the power load to be fed is disabled before enabling the disconnection of the male-female power terminal or terminals of the connector.

U.S. Pat. No. 5,542,425 discloses an apparatus and method for preventing the deterioration of the contacts in electric equipment, specifically in image acquisition equipment with an ultrasound system in which several probes can be linked to the acquisition system with no risk of an electric arc being able to jump when disconnecting said probes, in which system the connector includes a mechanically actuated element for actuating and deactivating a connection interface between components, including a sensor or detector determining when the connector is going to be disconnected by one of the components, and provides a signal used by one of the components for disabling the electric power feed to the connector and thus preventing electric arc formation upon physically separating the male-female terminals thereof. In the different examples illustrated by this patent, said element is a rotating shaft which the user must act on, and said sensor is an optical sensor, magnetic sensor or simple switch.

In the last two background examples, the feed source disconnection is carried out either by the user (as in U.S. Pat. No. B1-6,225,153) or by means of the addition of a sensor associated to a mechanism likewise actuated by the user (as in U.S. Pat. No. 5,542,425), being necessary to always act on the connector with means for suitably moving its contacts, delay generation being essential for suitable functioning due to the mechanical actuation conditions.

Unlike said background, in the system, method and connector of the present invention, the connector itself includes passive means, such as additional terminals associated to an auxiliary circuit which, due to their configuration or position in the connector, constitute detection means susceptible to generating a signal indicating a situation prior to disconnection of the power terminals of the connector during the decoupling run thereof. From said signal, a disconnection protection device disables the electric power feed to the connector at hand before the physical separation of the power terminals occurs. The connector of the present invention is of a conventional structure, including two socket coupling electroinsulating blocks, generally of multiple contacts.

The system provides for an electronic unit susceptible to individually controlling a plurality of different connectors interspersed at different points of the network for electric current distribution towards the power loads.

BRIEF EXPLANATION OF THE INVENTION

The system according to the invention, which is provided for preventing electric arc formation in connectors feeding power loads, is implemented on the basis of connectors interspersed in an electric power supply and distribution network. Each connector is of the type comprising first and second electroinsulating connection supports susceptible to releasable socket coupling, which supports carry at least a pair of power terminals, although they will generally have multiple contacts. The first and second electroinsulating supports can adopt a first definitive coupling position A in which said power terminals are electrically coupled together, forming an electric power through channel towards a corresponding power load. The first and second electroinsulating supports can adopt a second decoupling position C in which the power terminals are physically separated, preventing electric power passing towards the corresponding power load. As previously mentioned, the voltage level of said network is such that when the separation of the power terminals occurs, an electric arc can be generated. According to the invention, said connector comprises at least a pair of additional electroconductive elements for detection functions which, upon exceeding a preset threshold in an intermediate position B corresponding to a point of a decoupling run of the electroinsulating supports between said first position A and said second position C, form or interrupt an auxiliary electric circuit through which an electric warning signal is generated concerning said displacement of the supports towards the decoupling situation corresponding to second position C. At least one disconnection protection device, such as a power relay or FET power transistor, has been provided, connected to said auxiliary circuit, prepared so that, upon receiving said electric warning signal, it immediately cuts off the electric feed towards said channel formed by the power terminals of the connector before these reach said second position C, that is, before physical separation between them occurs, preventing an arc from being generated. In the case that the connector has multiple power contacts, a single pair of additional electroconductive elements serves for generating a single warning signal which triggers cutting off the current to all of the power contacts.

According to a preferred embodiment of the system according to the invention, said disconnection protection device, of which there is at least one, is integrated in an electronic unit adapted for controlling a plurality of connectors interspersed in different load feed lines. Said electronic unit comprises a circuit for identification of the connector or connectors in transition towards decoupling position B, which circuit is connected to a microprocessor controlling said disconnection protection device, which is linked to the electric power feed source and from which corresponding circuits or channels are formed which pass through a distribution connector and from this, they branch off towards the corresponding connectors and their electrically coupled terminals.

According to said embodiment, a line of the corresponding auxiliary circuit of each connector is received through said distribution connector, which lines are fed to said connector identification circuit which, according to which is the connector from which the warning signal is received, acts on the microprocessor sending a preferential interruption which generates a corresponding order to the disconnection protection device to disconnect the feed towards the power channel or lines passing through the corresponding connector.

BRIEF DESCRIPTION OF DRAWINGS

In order to better understand the invention, it will be described with the aid of several sheets of drawings which show several non-limiting embodiment examples of a possible implementation, according to the following detail.

DETAILED DESCRIPTION

Figure 1:
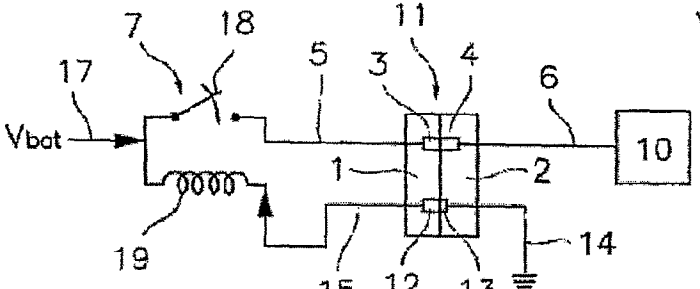
FIG. 1 shows a diagram of the system of the present invention according to its simplest embodiment.

First making reference to FIG. 1, the system of the invention for preventing electric arcs comprises, in its simplest embodiment, a load 10 to be fed and a feed line 17 connected by an electric power through channel 5, 6, a protection device 7 of the load 10 by disconnection of the feed line 17, and a connector 11 arranged on said channel 5, 6 between the device 7 and the load 10. The connector 11 is of the type comprising first and second releasable electroinsulating connection supports 1, 2 capable of mutual socket coupling, which carry a pair of power terminals 3, 4 connected to respective branches 5, 6 of the electric power through channel from the device 7 to the load 10. As in conventional cases, the electroinsulating supports 1, 2 of the connector 11 can adopt a first definitive coupling position A in which the terminals 3, 4 are electrically coupled together, forming said electric power through channel 5, 6, and a second total decoupling position C in which the terminals 3, 4 are physically separated. In this application, the feed network voltage level is high enough so as to generate an electric arc when said separation of the terminals 3, 4 is carried out.

To prevent the formation of said electric arc, the system of the invention includes a pair of additional electroconductive elements 12, 13 in the connector 11 which carry out a detection function of an intermediate position B of the electroinsulating supports 1, 2 located at a point of the decoupling displacement or run thereof between said first and second positions A and C. In said intermediate position B, it is essential that the power terminals 3, 4 are still coupled together. Said intermediate position B detection is carried out by means described below in reference to FIGS. 4*a* to 7*c*.

Said additional electroconductive elements 12, 13 are associated to an auxiliary electric circuit 14, 15 through which, and when detection of intermediate position B of the electroinsulating supports 1, 2 is carried out, an electric warning signal will be generated by virtue of which said disconnection protection device 7 immediately interrupts the electric feed towards the load 10 through said channel 5, 6 and, accordingly, the terminals 3, 4, before these reach said second position C of mutual physical separation. Therefore, when the decoupling run continues between the electroinsulating supports 1, 2 from intermediate position B, there is no longer current passing through the terminals 3, 4, and an electric arc jump is impossible when the physical separation between both of them is carried out upon having reached the second position C.

In the example of FIG. 1, said disconnection protection device 7 comprises, for example, a power relay represented as a switch 18 controlled by a coil 19. One of the detection terminals 13 of said pair of addition terminals 12, 13 of the connector 11 is connected to a ground connection 14, and said detection signal comprises the change from a minimum impedance situation, distinctive of the connection to said ground connection 14, to a maximum impedance situation in the conductor 15 when said ground connection is cut off.

Figure 2:
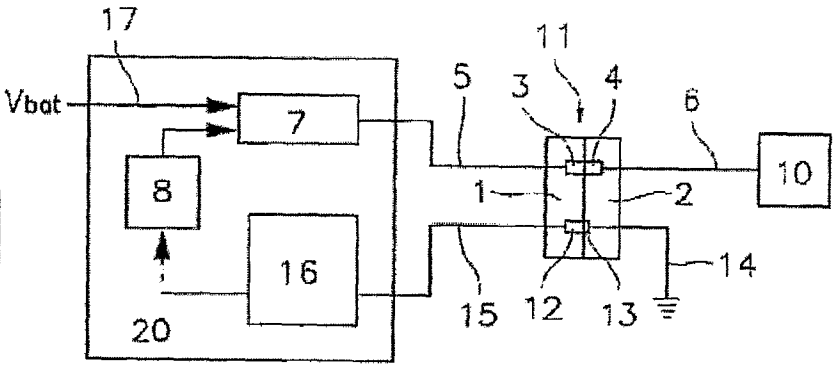
FIG. 2 shows a diagram of the present invention according to a more complete embodiment thereof.

In the diagram in FIG. 2, the load 10 and connector 10 are identical to those described above in relation to FIG. 1, whereas here, the disconnection protection device 7 is integrated in an electronic unit 20 or distribution box with the functioning of at least one microprocessor, in other words, a "smart" unit controlling the connector 11. Said unit 20 comprises an circuit 16 for identification of the connector 11 in intermediate position B, that is, in transition towards the second decoupling position C, which circuit 16 is connected to a microprocessor 8 controlling said disconnection protection device 7 which is linked to the electric power feed source by means of the feed line 17. The disconnection protection device 7 can be constituted of a power relay or FET power transistor and is connected to the load 10 through channel 5, 6 and terminals 3, 4 of the connector 11. The advantage of this configuration is that it is adapted for feeding and controlling several loads individually.

Figure 3:
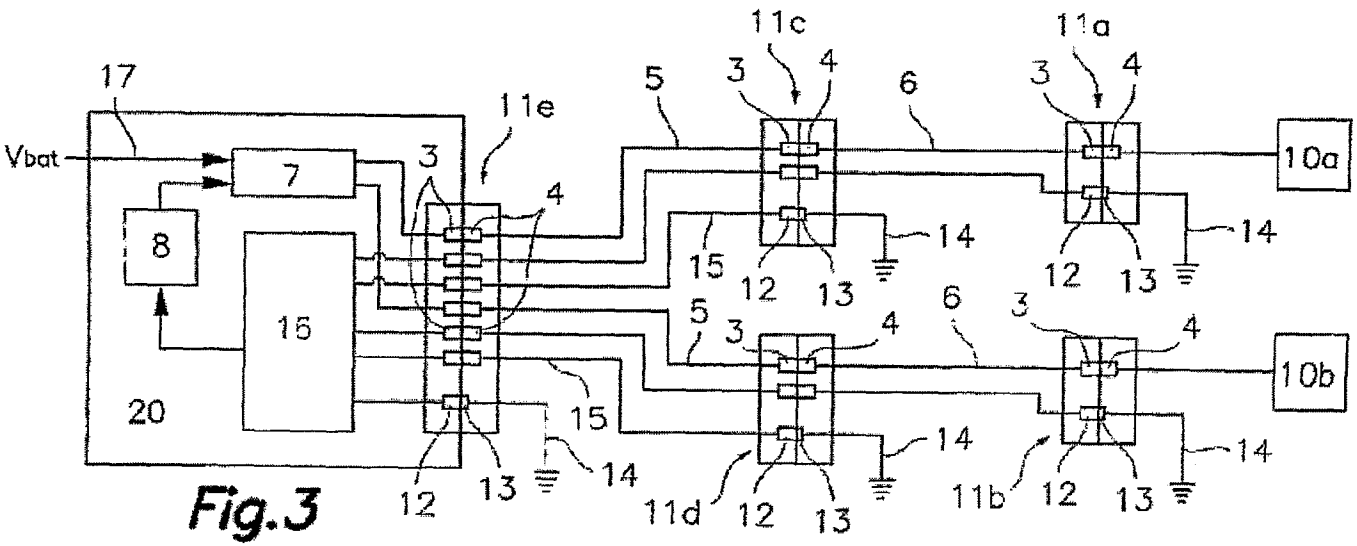
FIG. 3 shows a diagram of the system of the present invention according to an embodiment encompassing several connectors interspersed in a series of feed lines to loads.

The diagram in FIG. 3 shows the system of the present invention according to a more complex embodiment example in which there is a plurality of loads to be fed, which in FIG. 3 are represented by only two loads 10*a*, 10*b* for greater simplicity of the drawing. In a position close to each load 10*a*, 10*b* there is a corresponding connector 11*a*, 11*b* provided with its pair of power terminals 3, 4 and its pair of additional terminals 12, 13, one of which is connected to the corresponding ground connection 14. Between these connectors 11*a* and 11*b* and the electronic unit 20, there are other connectors 11*c*, 11*d*, each one of which comprises two pairs of terminals 3, 4 and a pair of additional terminals 12, 13 for connection to ground connection 14. At the input of the electronic unit 20, a distribution connector 11*e* is arranged, in this example provided with six pairs of terminals 3, 4 and a pair of addition terminals 12, 13 for connection to ground connection 14. Through this distribution connector 11*e*, the feed channels 5, 6 are arranged on one side from the disconnection protection device 7 towards the corresponding loads 10*a* and 10*b*, and the connections of the multiple ground connections 14 to the identification circuit 16 are arranged on the other side. Note that the number of terminals 3, 4 in the connectors 11*a*, . . . , 11*e* increases as the connector gets closer to the electronic unit 20. On the other hand, the closer the connector is to the distribution connector 11*e*, it will be hierarchically preferential with regard to the other successive connectors of the same line in which it is incorporated.

With the configuration shown in FIG. 3, the identification circuit 16 is able to identify the connector or connectors 11*a*, . . . , 11*e* which is in said intermediate position B, that is, in transition towards decoupling position C, by virtue of the signal it receives from the circuit or circuits connected to the respective ground connections and, according to which is the connector 11*a*, . . . , 11*e* from which the warning signal is received, it acts on the microprocessor 8 by sending a preferential interruption which generates from this microprocessor 8 a corresponding order to the disconnection protection device 7, which cuts off the feed to the corresponding load or loads 10*a*, 10*b* through the power channel or channels 5, 6 and terminals 3, 4 of the connector or connectors 11*a*, . . . , 11*e* involved.

It will be seen that in this arrangement, some of the connectors 11*a*, . . . , 11*e* are of multiple contacts, besides the additional detection contacts, which are assembled through a series of terminal pairs. However, in the connectors 11*c* and 11*d*, only a pair of terminals 3, 4 are power terminals, whereas the other pair of terminals serves to connect detection lines of other connectors, whereas the distribution connector 11*e* is connected to two feed channels 5, 6 of power loads 10*a*, 10*b* through other pairs of power terminals 3, 4, including a single pair of additional detection terminals 12, 13 which protect all the power terminals 3, 4 of said distribution connector 11*e* from the formation of electric arcs in cooperation with the electronic unit 20. The other pairs of terminals in the distribution connector 11*e* serve only for the connection of the lines coupled to ground connections 14 in other system connectors. Accordingly, it is possible to provide connectors according to the present invention provided with multiple power contacts and generally with a single detection contact.

The different positions A, B and C which the terminal supports can adopt and the manner in which the pair of additional terminals 12, 13 detects the intermediate position B is described below with reference to FIGS. 4*a* to 7*c*.

FIGS. 4*a* to 6*c* show first, second and third embodiment examples of the connector 11 of the present invention. In all of them, the connector 11 always comprises two supports 1, 2 of an electroinsulating material, which carry, in the example shown, two pairs of power terminals 3, 4 connected to respective power feed channel spans 5, 6 and a pair of additional terminals 12, 13 connected respectively to the detection line 15 and ground connection 14. Each one of the terminals is composed of a male pin 3, 12 and a female base 4, 13 susceptible to being coupled together. The elements of the pairs of terminals 3, 4 and 12, 13 are arranged on the mutually facing respective supports 1, 2 such that when said supports 1,2 are coupled, all the terminal pair elements are connected together.

The first and second electroinsulating supports 1, 2 of the connector 11 comprise mechanical closure means of mutual coupling thereof consisting of projections 21 formed on several resilient arms 22 joined to the first support 1 and first and second notches 23*a*, 23*b* incorporated on the second support 2. When the first and second supports are coupled together, the projections 21, by virtue of the resilient force of the arms 22, are first housed in the first notches 23*a*, momentarily retaining the supports 1, 2 in this position, and then in the second notches 23*b*. Similarly, decoupling is carried out in two steps: a first step in which a displacement occurs until the projections 21 are housed in the second notches 23*b*, and a second step until the complete separation of the supports 1, 2.

Figure 4A:
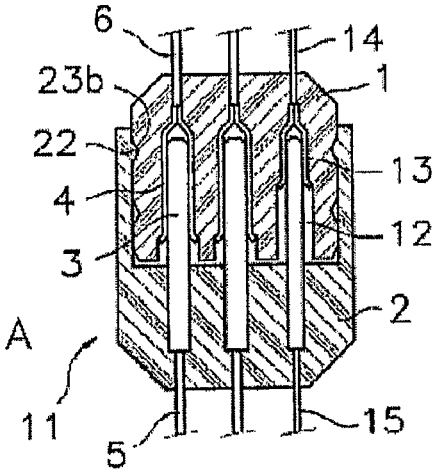
FIGS. 4*a*, 4*b* and 4*c* show sectional schematic views respectively showing positions A, B and C of the electroinsulating supports of the connector of the present invention according to a first embodiment example.
Figure 4B:
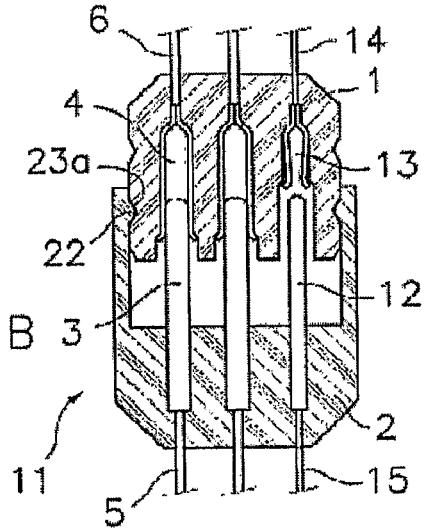
Figure 4C:
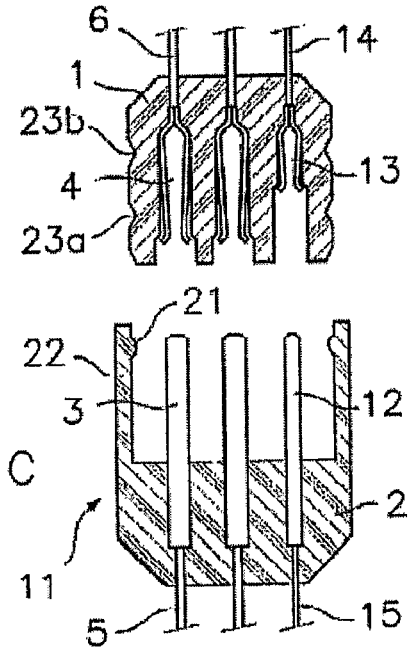

In the first embodiment example shown in FIGS. 4*a* to 4*c*, the male pins 3, 12 respectively corresponding to the power and detection terminals have a same length, whereas the female base 13 of the detection terminal is shorter than the female bases of the power terminals.

In a first definitive coupling position A shown in FIG. 4*a*, the projections 21 are housed in the second notches 23*b*, and both the power terminals 3, 4 and detection terminals 12, 13 are coupled.

In an intermediate position B shown in FIG. 4*b*, the projections 21 are housed in the first notches 23*a*, and the power terminals 3, 4 remain coupled, whereas the detection terminals 12, 13 have been disconnected, that is, they have lost contact with one another. In this intermediate position B, the auxiliary circuit 14, 15 is open and a detection signal is generated as has been described above with reference to FIGS. 1 to 3, by virtue of which signal the system cuts off the power current of the circuit 5, 6. Accordingly, in intermediate position B, even though the power terminals 3, 4 are still mutually connected, no electric current passes through them and they are not live.

In a second position C shown in FIG. 4*c*, the supports 1, 2 of the connector 11 lose contact between each other, and the power terminals 3, 4 are disconnected with no risk of generating an electric arc due to the absence of voltage therein.

Figure 5A:
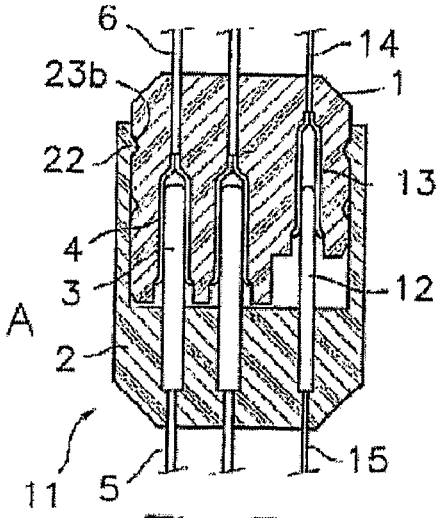
FIGS. 5*a*, 5*b* and 5*c* show sectional schematic views respectively showing positions A, B and C of the electroinsulating supports of the connector of the present invention according to a second embodiment example.
Figure 5B:
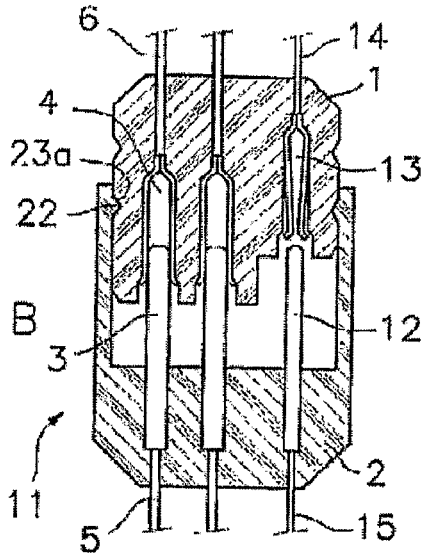
Figure 5C:
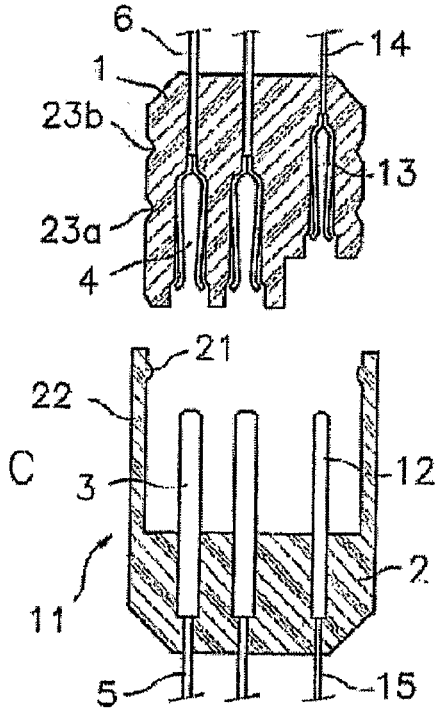

In the second embodiment example shown in FIGS. 5*a* to 5*c*, the male pins 3, 12 respectively corresponding to the power and detection terminals have a same length like their respective female bases 4, 13, even though the female base 13 of the detection terminal is more withdrawn than the female bases of the power terminals. Here, the material of the second electroinsulating support 2 is also withdrawn from the entry area of the female base 13, leaving a stepped cavity or recess, when the supports 1, 2 are coupled (FIG. 5*a*).

Positions A, B and C of this second embodiment example, shown respectively in FIGS. 5*a*, 5*b* and 5*c*, are similar to positions A, B and C of the first embodiment example shown in FIGS. 4*a*, 4*b* and 4*c*, and they produce the same effects, therefore their description has been omitted.

Figure 6A:
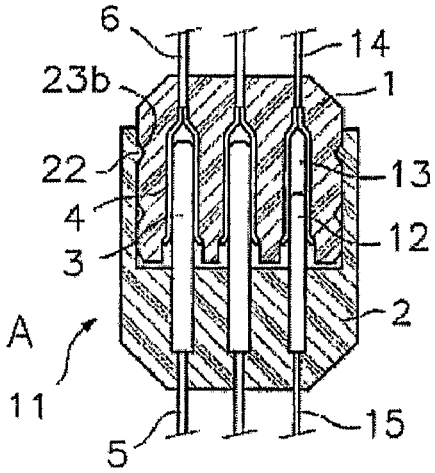
FIGS. 6*a*, 6*b* and 6*c* show sectional schematic views respectively showing positions A, B and C of the electroinsulating supports of the connector of the present invention according to a third embodiment example.
Figure 6B:
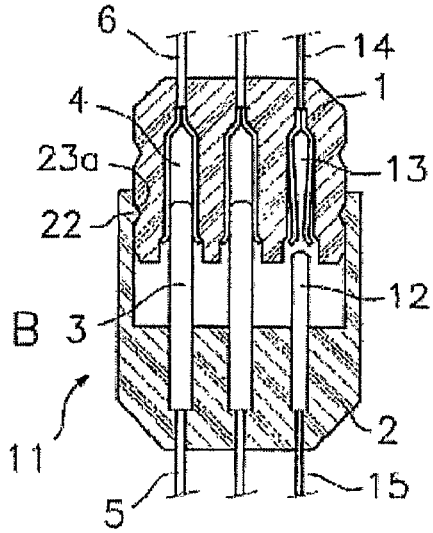
Figure 6C:
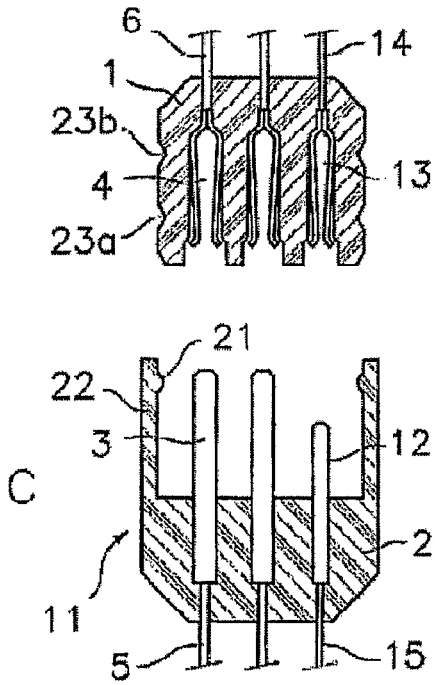

In the third embodiment example shown in FIGS. 6*a* to 6*c*, the male pin 12 corresponding to the detection terminals is shorter than the male pins 3 of the power terminals, whereas their respective female bases 4, 13 all have the same length.

Positions A, B and C of this third embodiment example, shown respectively in FIGS. 6*a*, 6*b* and 6*c*, are similar to positions A, B and C of the first embodiment example shown in FIGS. 4*a*, 4*b* and 4*c*, and they produce the same effects, therefore their description has been omitted.

Figure 7A:
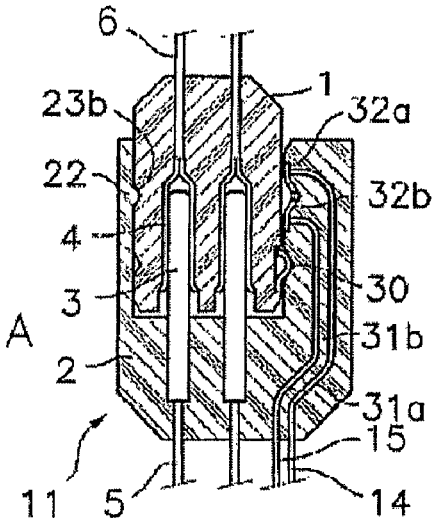
FIGS. 7*a*, 7*b* and 7*c* show sectional schematic views respectively showing positions A, B and C of the electroinsulating supports of the connector of the present invention according to a fourth embodiment example.
Figure 7B:
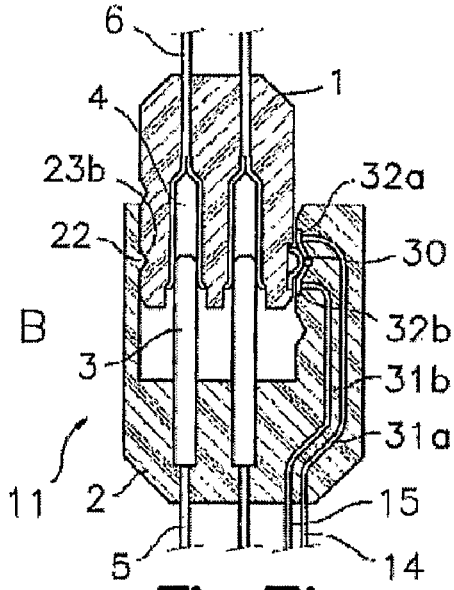
Figure 7C:
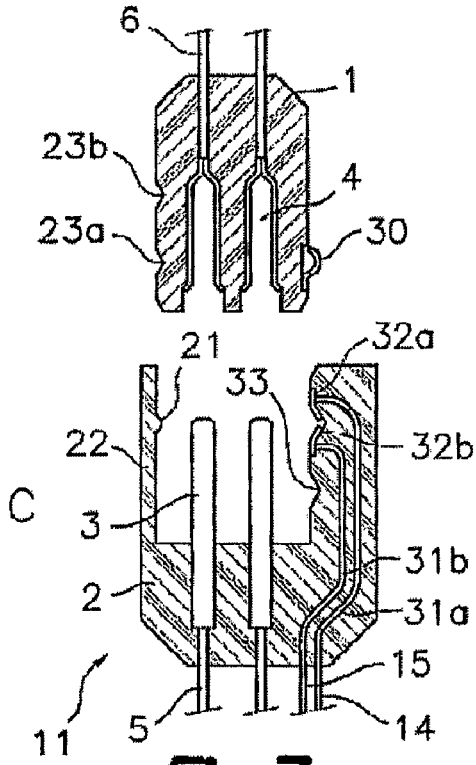

FIGS. 7*a* to 7*c* show a fourth embodiment example in which the power terminals adopt the shape of two pairs of male pin 3 and female base 4, whereas the detection terminals include an electroconductive part 30 fixed to the first electroinsulating support 1 of the connector 11 and two spaced conducting strips 32*a*, 32*b* fixed to the second support 2 of the connector 11 in a position such that said electroconductive part 30, during the coupling and decoupling of the first and second supports 1, 2, overlaps and bridges said strips 32*a*, 32*b*. Inside of the second support 2, two branches 31*a*, 31*b* of the electric detection circuit connected to the ground connection 14 and the connection channel 15 to the electronic unit 20 are arranged. In this fourth embodiment example, the second support 2 incorporates a single resilient arm 22 with a projection 21, and the first support 1 incorporates said first and second notches 23*a* and 23*b* on the corresponding side.

In a first position A shown in FIG. 7*a*, the first and second electroinsulating supports 1, 2 are coupled, the projection 21 is housed in the second notch 23*b*, and the power terminals 3, 4 are completely connected. For its part, the electroconductive part 30, which adopts the shape of an resilient projection, is housed in a notch 33 formed on the second support 2 of the connector 11, at a suitable distance from the two conductive strips 32*a*, 32*b* which together form another notch or recess. Accordingly, the electric detection circuit formed by the two branches 31*a*, 31*b* is open and current does not circulate between the ground connection 14 and the connection channel 15.

In an intermediate position B shown in FIG. 7*b*, the projection 21 is housed in the first notch 23*a*, and the power terminals 3, 4 remain coupled. On the contrary, the electroconductive part 30 is housed in the notch or recess formed between the two conductive strips 32*a*, 32*b*, forming a bridge contact between them such that the electric detection circuit formed by the two branches 31*a*, 31*b* is closed and current circulates from the ground connection 14 towards the electronic unit 20 through the connection channel 15. This generates a detection signal upon changing from a maximum impedance situation in the conductor 15 to a minimum impedance situation, distinctive of the connection to said ground connection 14, opposite of how it has been described above with reference to FIG. 1. By virtue of said signal, the system cuts off the power current of the circuit 5, 6. Accordingly, in intermediate position B, even though the power terminals 3, 4 are mutually connected, current does not pass through them and they are not live.

In a second position C shown in FIG. 7*c*, the supports 1, 2 of the connector 11 lose mutual contact, and the power terminals 3, 4 are disconnected with no risk of generating an electric arc since current is not passing through them. The electroconductive part 30 stops making contact between the two conductive strips 32*a*, 32*b* such that the electric detection circuit formed by the branches 31*a*, 31*b* is again open.

It can be seen that in all the disclosed embodiment examples, detection contacts 12, 13 and 30, 31*a*, 31*b* associated to an auxiliary circuit are included in addition to the power terminals 3, 4. The decoupling action of the first and second electroinsulating supports 1, 2 of the connector 11 is preferably carried out in two steps, with the aid of said notch configurations. In a first step, a displacement between the first and second supports 1, 2 occurs until overcoming a threshold in the decoupling run which generates a momentary or permanent disconnection or connection of detection contacts 12, 13; 30, 31*a*, 31*b* without there being a disconnection of the power terminals 3, 4. Said momentary or permanent disconnection or connection of the detection contacts 12, 13; 30, 31*a*, 31*b* generates a signal used by the control unit to cut off the current to the power terminals 3, 4. In a second decoupling step, the definitive disconnection of the pair of power terminals 3, 4 is produced with no risk of an electric arc being generated, since current no longer passes through them.

The essential features of the invention are detailed in the following claims.

The invention claimed is:

1. A system for preventing electric arcs in connectors feeding power loads, which connectors (11), interspersed in an electric power supply and distribution network, are of the type comprising first and second releasable socket coupling electro_insulating connection supports (1, 2) bearing at least one pair of terminals (3, 4), said at least one pair of terminals (3, 4) characterized as forming a plurality of feed channels (5, 6) of several respective power loads (10*a*, 10*b*, . . . ), and in that each connector (11) integrates two electro conductive detection contact terminals or parts (13, 14), susceptible to forming said auxiliary circuit (14, 15) in said first position A, or in intermediate position B of a decoupling run between the electro insulating connection supports (1, 2) and before said terminals (3, 4) reach said second position C, and further characterized as having a first one of the electro insulating connection supports (1), or male body, carries on its side wall an electro conductive part (30), whereas in the cavity of the second connection support (2), or female body, two branches (31*a*, 31*b*) of an electric circuit are arranged, which end in two spaced conductive strips (32*a*, 32*b*) which open into a cavity of the side wall of support (2), such that in the decoupling run, the part (30) is arranged on said cavity, connecting said strips (32*a*, 32*b*), closing the circuit formed by the branches (31*a*, 31*b*) and through which the sending of the warning signal is generated towards the disconnection device (7) of feed to the conductive channels formed by said power terminals (3, 4) before reaching physical separation thereof which, in a first definitive coupling position A, are electrically coupled together, forming an electric power through channel (5, 6) towards a corresponding power load (10), and which terminals (3, 4) in a second decoupling position C of the electro_insulating connection supports (1, 2) are physically separated, the voltage level of said network being such that said separation can generate an electric arc, characterized in that each one of said connections (11) comprises at least a pair of additional electro_conductive elements (12, 13) for detection purposes which, in said first position A, or in intermediate position B of a decoupling run between the electro_insulating connection supports (1, 2) and before said terminals (3, 4) reach said second position C, form an auxiliary electric circuit (14, 15) through which it is susceptible to generating an electric warning signal in correspondence with a displacement of the supports (1, 2) towards a decoupling situation and upon overcoming a preset threshold in the decoupling run, and in that at least one disconnection protection device (7) has been provided, connected to said auxiliary circuit (14, 15), prepared so that upon receiving said electric warning signal, it immediately interrupts the electric fed to said channel (5, 6) formed by said two terminals (3, 4) before the latter reach said second position C of physical separation between them.

2. A system for preventing electric arcs in connectors feeding power loads, which connectors (11), interspersed in an electric power supply and distribution network, are of the type comprising first and second releasable socket coupling electro insulating connection supports (1, 2) bearing at least one pair of terminals (3, 4), said at least one pair of terminals (3, 4) characterized as forming a plurality of feed channels (5, 6) of several respective power loads (10*a*, 10*b*, . . . ) wherein between each load (10*n*, 10*b*) and the electronic unit (20), one or more connectors (11*b*–11*e*) are interspersed, each one of said connectors (11*b*–11*e*) including one of said pairs of detection terminals (12, 13), by which the number of terminals present in each connector (11*b*–11*e*) increases the closer the connector is to the electronic unit (20), and in that each connector (11) integrates two electro conductive detection contact terminals or parts (13, 14), susceptible to forming said auxiliary circuit (14, 15) in said first position A, or in intermediate position B of a decoupling run between the electro insulating connection supports (1, 2) and before said terminals (3, 4) reach said second position C, and further characterized as having which, in a first definitive coupling position A, are electrically coupled together, forming an electric power through channel (5, 6) towards a corresponding power load (10), and which terminals (3, 4) in a second decoupling position C of the electro_insulating connection supports (1, 2) are physically separated, the voltage level of said network being such that said separation can generate an electric arc, characterized in that each one of said connections (11) comprises at least a pair of additional electro_conductive elements (12, 13) for detection purposes which, in said first position A, or in intermediate position B of a decoupling run between the electro_insulating connection supports (1, 2) and before said terminals (3, 4) reach said second position C, form an auxiliary electric circuit (14, 15) through which it is susceptible to generating an electric warning signal in correspondence with a displacement of the supports (1, 2) towards a decoupling situation and upon overcoming a preset threshold in the decoupling run, and in that at least one disconnection protection device (7) has been provided characterized in that said disconnection protection device (7), of which there is at least one, is integrated in an electronic unit (20) or distribution box which controls a plurality of connectors (11*b*, 11*c*, 11*d*, 11*e*) and which unit (20) comprises a circuit (16) for identification of the connector or connectors (11) in transition towards decoupling position B, which circuit (16) is connected to a microprocessor (8) controlling said disconnection protection device (7) linked to the electric power feed source and from which several corresponding circuits or channels are formed which pass through a distribution connector (11*e*) and from which they branch off towards the corresponding connectors (11) and their electrically coupled terminals (3, 4), and further characterized in that through said distribution connector (11*e*), a line of the corresponding auxiliary circuit (14, 15) of each connector (11) is received, which lines are fed to said connector identification circuit (16) which, according to which is the connector (11) from which the warning signal is received, acts on the microprocessor (8) by sending a preferential interruption which generates a corresponding order to the disconnection protection device (7) to disconnect the feed towards the power channel or lines passing through the corresponding connector (11); connected to said auxiliary circuit (14, 15), prepared so that upon receiving said electric warning signal, it immediately interrupts the electric fed to said channel (5, 6) formed by said two terminals (3, 4) before the latter reach said second position C of physical separation between them.

* * * * *